US010210826B2

(12) United States Patent
Chuang

(10) Patent No.: US 10,210,826 B2
(45) Date of Patent: Feb. 19, 2019

(54) SUB-PIXEL RENDERING METHOD FOR DELTA RGBW PANEL AND DELTA RGBW PANEL WITH SUB-PIXEL RENDERING FUNCTION

(71) Applicant: HIMAX TECHNOLOGIES LIMITED, Tainan (TW)

(72) Inventor: Chi-Feng Chuang, Tainan (TW)

(73) Assignee: HIMAX TECHNOLOGIES LIMITED, Tainan (TW)

( * ) Notice: Subject to any disclaimer, the term of this patent is extended or adjusted under 35 U.S.C. 154(b) by 105 days.

(21) Appl. No.: 15/438,760

(22) Filed: Feb. 22, 2017

(65) Prior Publication Data

US 2018/0240416 A1 Aug. 23, 2018

(51) Int. Cl.

| | |
|---|---|
| ***G09G 5/02*** | (2006.01) |
| ***G09G 3/36*** | (2006.01) |
| ***G09G 5/00*** | (2006.01) |

(52) U.S. Cl.

CPC ..... *G09G 3/3607* (2013.01); *G09G 5/00* (2013.01); *G09G 2320/0242* (2013.01); *G09G 2320/0247* (2013.01); *G09G 2340/0457* (2013.01)

(58) Field of Classification Search

CPC ..... G09G 3/3607; G09G 2340/0457; G09G 2320/0242; G09G 2320/0247; G09G 5/02

See application file for complete search history.

(56) References Cited

U.S. PATENT DOCUMENTS 9,171,491 B1 * 10/2015 Kwon ..... G09G 3/3648
9,886,884 B2 * 2/2018 Zhou ..... G09G 3/2003
2005/0151752 A1 * 7/2005 Phan ..... G09G 3/2003 345/589
2007/0159492 A1 * 7/2007 Lo ..... G09G 5/026 345/589
2008/0231577 A1 * 9/2008 Lin ..... G09G 3/3607 345/90
2010/0013848 A1 * 1/2010 Hekstra ..... G09G 3/20 345/589

(Continued)

FOREIGN PATENT DOCUMENTS

CN 102483898 A 5/2012
CN 103106860 A 5/2013

(Continued)

OTHER PUBLICATIONS

Lu fang, oscar c. au, ketan tang and xing wen, Increasing image resolution on portable displays by subpixel rendering—a systematic overview, SIP (2012), vol. 1, e1, p. 1 of 10.*

*Primary Examiner* — Nitin Patel
*Assistant Examiner* — Amy C Onyekaba
(74) *Attorney, Agent, or Firm* — Winston Hsu

(57) ABSTRACT

A sub-pixel rendering method for a Delta RGBW panel and a Delta RGBW panel with sub-pixel rendering function are provided. The sub-pixel rendering method for a Delta RGBW panel is disclosed. The method comprises: utilizing a controller to classify all sub-pixels of the Delta RGBW panel into a first type of sub-pixels, a second type of sub-pixels, and a third type of sub-pixels; rendering the first type of sub-pixels by a left pixel, a current pixel, and a right pixel; rendering the second type of sub-pixels by a current pixel and a right pixel; and rendering the third type of sub-pixels by a left pixel and a current pixel.

8 Claims, 12 Drawing Sheets

(56) References Cited

U.S. PATENT DOCUMENTS

2010/0103187 A1* 4/2010 Linssen ..... G03G 3/2003 345/590
2010/0149204 A1* 6/2010 Han ..... G09G 5/02 345/589
2011/0057950 A1* 3/2011 Kim ..... G09G 5/02 345/602
2011/0148908 A1* 6/2011 Jeong ..... G09G 5/02 345/590
2011/0279493 A1* 11/2011 Phan ..... G09G 3/20 345/694
2012/0206513 A1* 8/2012 Ueno ..... G09G 3/3413 345/697
2012/0262362 A1* 10/2012 Uehara ..... G02B 27/2214 345/88
2013/0027285 A1* 1/2013 Inada ..... G09G 3/3607 345/88
2013/0120472 A1* 5/2013 Byun ..... G09G 5/02 345/690
2014/0043357 A1* 2/2014 Yamato ..... G09G 3/3607 345/603
2014/0204321 A1* 7/2014 Koh ..... G02F 1/133514 349/109
2014/0347528 A1* 11/2014 Tachi ..... G06T 3/4015 348/242
2015/0002552 A1* 1/2015 Takagi ..... G09G 3/2003 345/690
2015/0363944 A1* 12/2015 Elliott ..... G06T 3/4015 345/589
2015/0371580 A1* 12/2015 Yashiki ..... G09G 3/3413 345/691
2015/0371605 A1* 12/2015 Wu ..... G09G 5/02 345/604
2016/0132999 A1* 5/2016 Kwon ..... G06T 5/008 345/593
2016/0171918 A1 6/2016 Kim
2017/0053582 A1* 2/2017 Hsu ..... G06T 5/003
2017/0069252 A1* 3/2017 Guo ..... G09G 3/2074
2017/0256193 A1* 9/2017 Zhou ..... G09G 3/2003
2017/0263171 A1* 9/2017 Li ..... G09G 3/2003
2018/0040284 A1* 2/2018 Kang ..... G09G 3/3607
2018/0211577 A1* 7/2018 Pan ..... G09G 3/2003

FOREIGN PATENT DOCUMENTS

TW 201331922 A1 8/2013
TW 201601138 A 1/2016

* cited by examiner

SUB-PIXEL RENDERING METHOD FOR DELTA RGBW PANEL AND DELTA RGBW PANEL WITH SUB-PIXEL RENDERING FUNCTION

BACKGROUND OF THE INVENTION

1. Field of the Invention

The present invention relates to a sub-pixel rendering method, and more particularly, to a sub-pixel rendering method for a Delta RGBW panel and a Delta RGBW panel with sub-pixel rendering function.

2. Description of the Prior Art

Please refer to FIG. 1 and FIG. 2. FIG. 1 is a simplified diagram of a Delta RGBW panel 100, and FIG. 2 is a simplified diagram of a conventional sub-pixel rendering algorithm for the Delta RGBW panel 100. As shown in FIG. 1, the Delta RGBW panel 100 has 3 sub-pixels per pixel and 2 sub-pixels shift on next line, and the pixel types repeat every 4 pixels. As shown in FIG. 2, the conventional sub-pixel rendering algorithm performs the 16 channels data on the 12 channels panel (i.e. transforming the 16 sub-pixels data to the 12 sub-pixels data in the way of pixel by pixel). The Delta RGBW 100 has an advantage of brightness improvement since adding the sub-pixel W can get brighter performance, and thus the brightness enhancing film can be omitted in the Delta RGBW 100. However, the conventional sub-pixel rendering algorithm for the Delta RGBW panel 100 has defects of causing sub-pixel level color bleeding and worse sub-pixel level text performance due to the jaggy issue of vertical gray line, wherein the jaggy issue is caused by the sub-pixel G and the sub-pixel W on the same vertical line rendering with different weighting by adjacent pixels. Moreover, serious shift flickers occurs when display content shifts on horizontal direction because of color bleeding issue. Please refer to FIG. 3. FIG. 3 is a simulation result of the conventional sub-pixel rendering algorithm for the Delta RGBW panel 100 showing the color bleeding issue and the jaggy issue. Moreover, please refer to FIG. 4. FIG. 4 is a simulation result of the conventional sub-pixel rendering algorithm for the Delta RGBW panel 100 showing that one pixel width slash line is disconnected when only one pixel outputs for one pixel inputs.

SUMMARY OF THE INVENTION

It is therefore one of the objectives of the disclosure to provide a sub-pixel rendering method for a Delta RGBW panel and a Delta RGBW panel with sub-pixel rendering function capable of reducing color bleeding in sub-pixel level and shift flickers due to color bleeding issue and reducing jaggy issue of vertical gray line and solving one pixel width slash line disconnection issue, so as to solve the problems mentioned above.

In accordance with an embodiment of the present invention, a sub-pixel rendering method for a Delta RGBW panel is disclosed. The method comprises: utilizing a controller to classify all sub-pixels of the Delta RGBW panel into a first type of sub-pixels, a second type of sub-pixels, and a third type of sub-pixels; rendering the first type of sub-pixels by a left pixel, a current pixel, and a right pixel; rendering the second type of sub-pixels by a current pixel and a right pixel; and rendering the third type of sub-pixels by a left pixel and a current pixel.

In accordance with an embodiment of the present invention, a Delta RGBW panel with sub-pixel rendering function is disclosed. The Delta RGBW panel comprises: a controller, for classifying all sub-pixels of the Delta RGBW panel into a first type of sub-pixels, a second type of sub-pixels, and a third type of sub-pixels; rendering the first type of sub-pixels by a left pixel, a current pixel, and a right pixel; rendering the second type of sub-pixels by a current pixel and a right pixel; and rendering the third type of sub-pixels by a left pixel and a current pixel.

In accordance with an embodiment of the present invention, a sub-pixel rendering method for a Delta RGBW panel is disclosed. The method comprises: utilizing a controller to apply a first type of pixel data to output a first type of sub-pixels; utilizing the controller to apply a second type of pixel data to output the first type of sub-pixels and a second type of sub-pixels; utilizing the controller to apply a third pixel data to output the second type of sub-pixels and a third type of sub-pixels; and utilizing the controller to apply a fourth pixel data to output the third type of sub-pixels and the first type of sub-pixels.

In accordance with an embodiment of the present invention, a Delta RGBW panel with a sub-pixel rendering function is disclosed. The Delta RGBW panel comprises: a controller, for applying a first type of pixel data to output a first type of sub-pixels; applying a second type of pixel data to output the first type of sub-pixels and a second type of sub-pixels; applying a third pixel data to output the second type of sub-pixels and a third type of sub-pixels; and applying a fourth pixel data to output the third type of sub-pixels and the first type of sub-pixels.

Briefly summarized, the sub-pixel rendering method for the Delta RGBW panel and the Delta RGBW panel with sub-pixel rendering function disclosed by the embodiments are capable of reducing color bleeding in sub-pixel level and shift flickers due to color bleeding issue and reducing jaggy issue of vertical gray line, and solving one pixel width slash line disconnection issue.

These and other objectives of the present invention will no doubt become obvious to those of ordinary skill in the art after reading the following detailed description of the preferred embodiment that is illustrated in the various figures and drawings.

DETAILED DESCRIPTION

Certain terms are used throughout the following description and the claims to refer to particular system components. As one skilled in the art will appreciate, manufacturers may refer to a component by different names. This document does not intend to distinguish between components that differ in name but not function. In the following discussion and in the claims, the terms "include", "including", "comprise", and "comprising" are used in an open-ended fashion, and thus should be interpreted to mean "including, but not limited to . . . ". The terms "couple" and "coupled" are intended to mean either an indirect or a direct electrical connection. Thus, if a first device couples to a second device, that connection may be through a direct electrical connection, or through an indirect electrical connection via other devices and connections.

Figure 1:
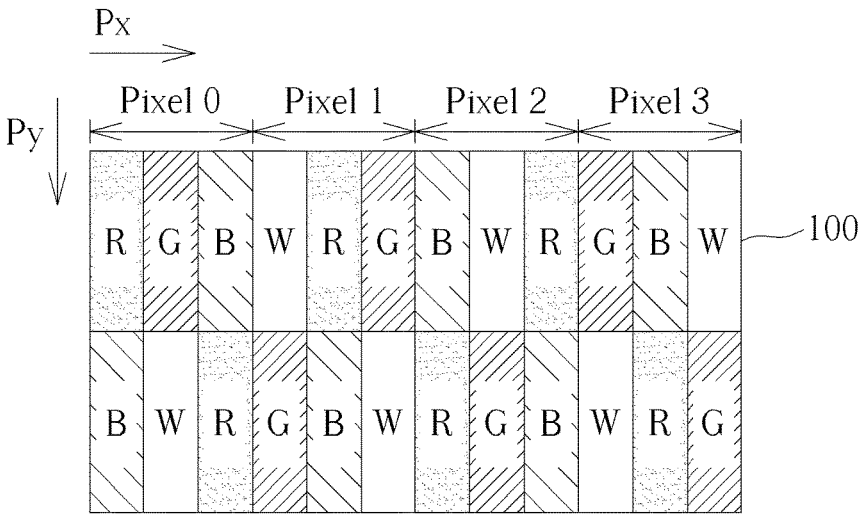
FIG. 1 PRIOR ART
FIG. 1 is a simplified diagram of a Delta RGBW panel.
Figure 2:
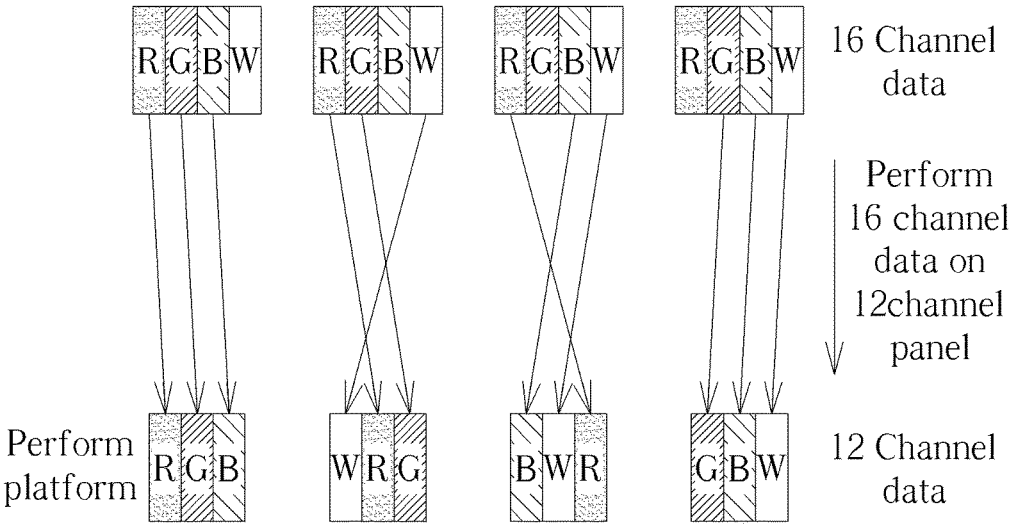
FIG. 2 PRIOR ART
FIG. 2 is a simplified diagram of a conventional sub-pixel rendering algorithm for the Delta RGBW panel.
Figure 3:
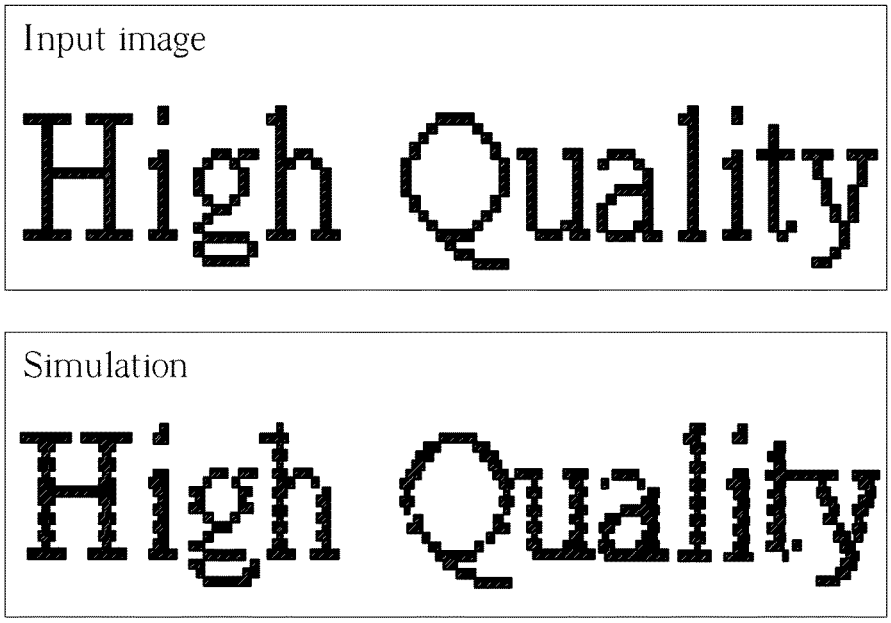
FIG. 3 PRIOR ART
FIG. 3 is a simulation result of the conventional sub-pixel rendering algorithm for the Delta RGBW panel 100 showing the color bleeding issue and the jaggy issue.
Figure 4:
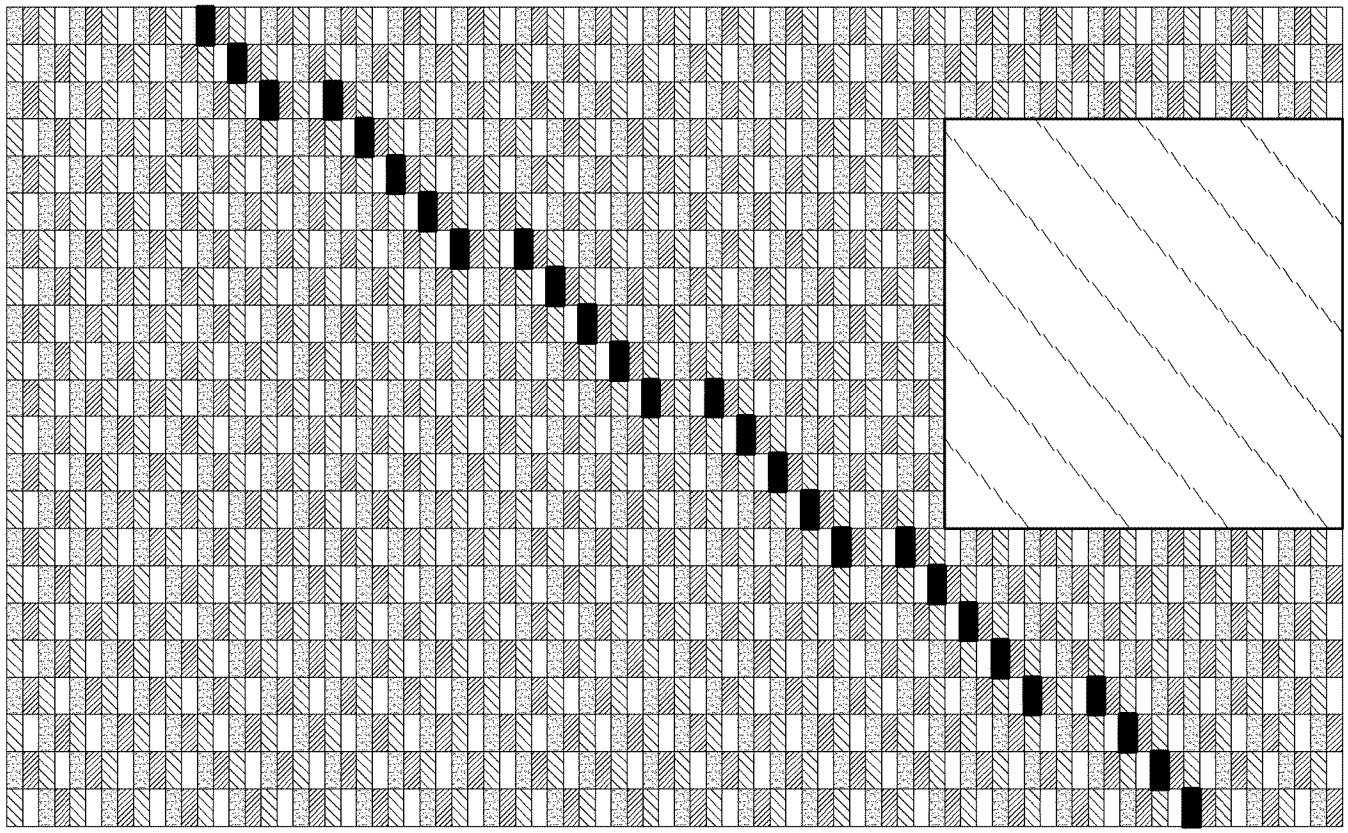
FIG. 4 PRIOR ART
FIG. 4 is a simulation result of the conventional sub-pixel rendering algorithm for the Delta RGBW panel showing that one pixel width slash line is disconnected when only one pixel outputs for one pixel inputs.
Figure 5:
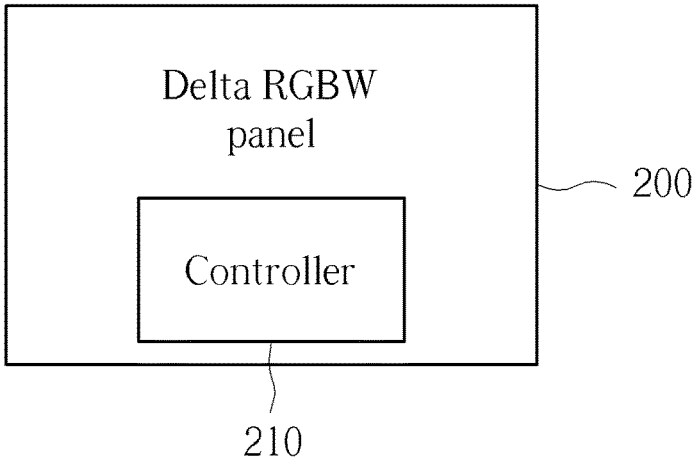
FIG. 5 shows a simplified block diagram of a Delta RGBW panel with a sub-pixel rendering function in accordance with an embodiment of the present invention.
Figure 6A:
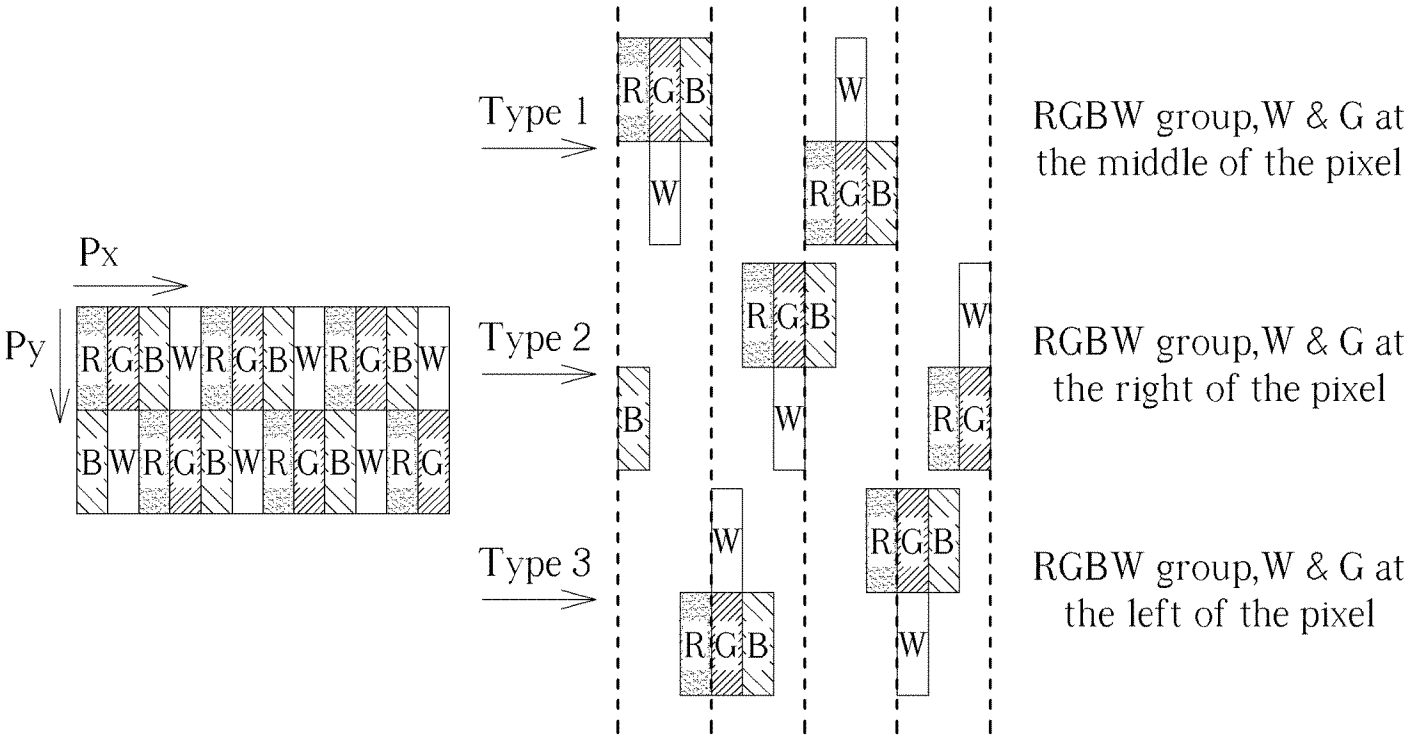
FIG. 6A and FIG. 6B show a simplified diagram of a sub-pixel rendering method for the Delta RGBW panel in accordance with an embodiment of the present invention.
Figure 6B:
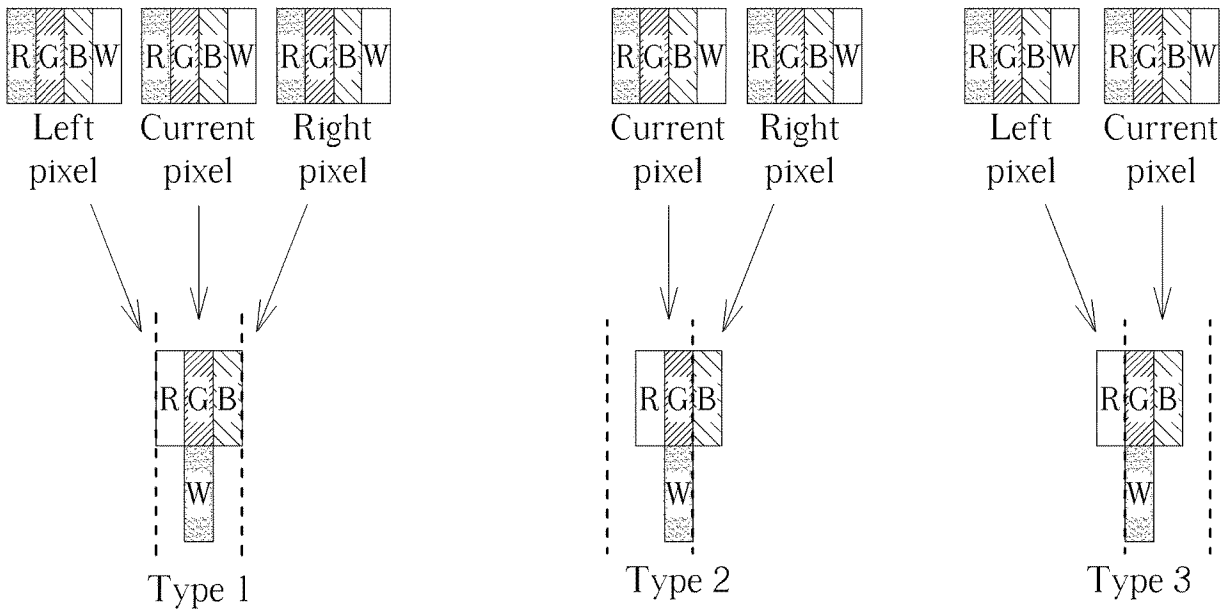

Please refer to FIG. 5, FIG. 6A, and FIG. 6B show. FIG. 5 shows a simplified block diagram of a Delta RGBW panel 200 with a sub-pixel rendering function in accordance with an embodiment of the present invention, wherein the Delta RGBW panel 200 can be a liquid crystal display (LCD) panel. FIG. 6A and FIG. 6B show a simplified diagram of a sub-pixel rendering method for the Delta RGBW panel 200 in accordance with an embodiment of the present invention. As shown in FIG. 5, the Delta RGBW panel 200 comprises: a controller 210. As shown in FIG. 6A and FIG. 6B, the controller 210 is utilized for classifying all sub-pixels (RGBW) of the Delta RGBW panel 200 into a first type of sub-pixels, a second type of sub-pixels, and a third type of sub-pixels; rendering the first type of sub-pixels by a left pixel, a current pixel, and a right pixel; rendering the second type of sub-pixels by a current pixel and a right pixel; and rendering the third type of sub-pixels by a left pixel and a current pixel. The first type of sub-pixels is a RGBW group where the sub-pixels G, W are at the middle of the pixel. The second type of sub-pixels is a RGBW group where the sub-pixels G, W are at the right side of the pixel. The third type of sub-pixels is a RGBW group where the sub-pixels G, W are at the left side of the pixel. Thus, the three types of sub-pixels all comprise complete sub-pixels R, G, B, W, and each of the three RGBW groups is reference the same weight from the reference pixels (i.e. the left pixel, the current pixel, or the right pixel), wherein the sub-pixels R, G, B in each RGBW group reference the same rule to prevent sub-pixel level color bleeding, and the sub-pixels G, W reference the same rule to prevent vertical gray line jaggy since the sub-pixels G, Ware easy to be focus, and the vertical gray line can be connected without using any line buffer.

In addition, the function of the controller 210 of rendering the first type of sub-pixels by the left pixel, the current pixel, and the right pixel can further comprise: setting a weight for weighting the left pixel; setting a weight for weighting the current pixel; setting a weight for weighting the right pixel; and rendering the first type of sub-pixels by the weighted left pixel, the weighted current pixel, and the weighted right pixel. The function of the controller 210 of rendering the second type of sub-pixels by the current pixel and the right pixel can further comprise: setting a weight for weighting the current pixel; setting a weight for weighting the right pixel; rendering the second type of sub-pixels by the weighted current pixel and the weighted right pixel. The function of the controller 210 of rendering the third type of sub-pixels by the left pixel and the current pixel can further comprise: setting a weight for weighting the left pixel; setting a weight for weighting the current pixel; rendering the first type of sub-pixels by the weighted left pixel and the weighted current pixel.

Figure 7:
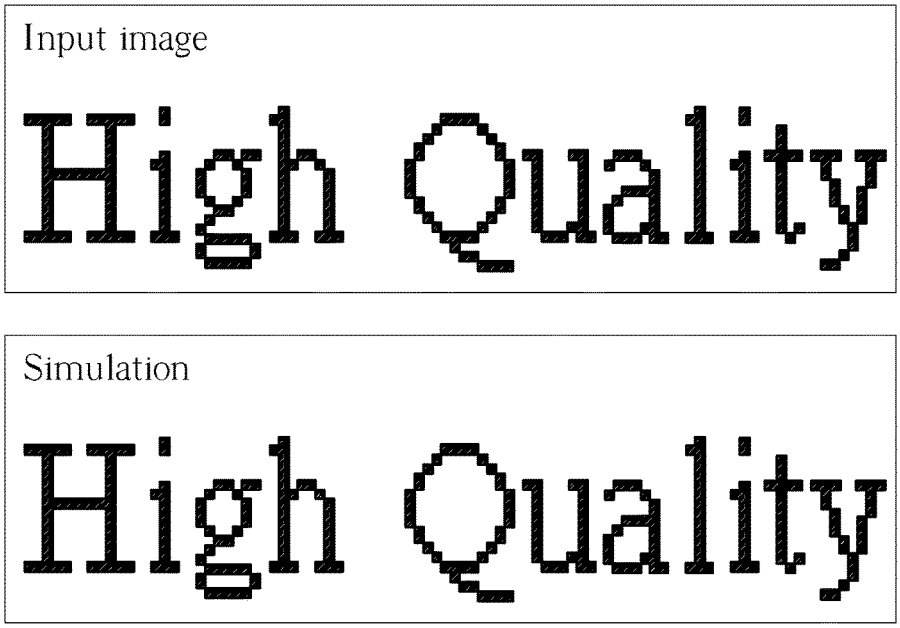
FIG. 7 is a simulation result of the Delta RGBW panel reducing the color bleeding issue and the jaggy issue in accordance with an embodiment of the present invention.
Figure 8:
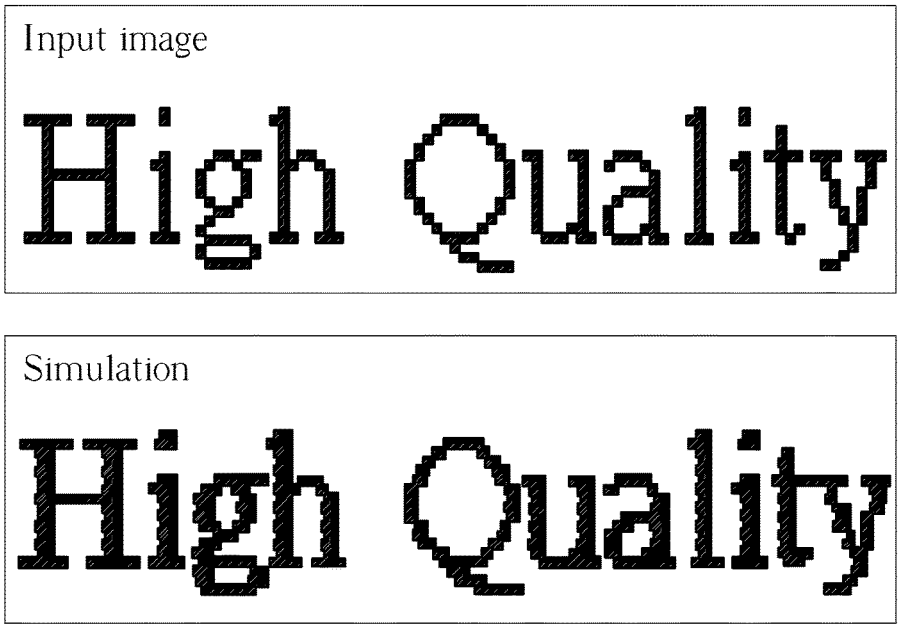
FIG. 8 is a simulation result of the Delta RGBW panel reducing the color bleeding issue and the jaggy issue in accordance with another embodiment of the present invention.

For example, please refer to FIG. 7 and FIG. 8. FIG. 7 is a simulation result of the Delta RGBW panel 200 reducing the color bleeding issue and the jaggy issue in accordance with an embodiment of the present invention. FIG. 8 is a simulation result of the Delta RGBW panel 200 reducing the color bleeding issue and the jaggy issue in accordance with another embodiment of the present invention. In FIG. 7, the function of the controller 210 of rendering the first type of sub-pixels by the left pixel, the current pixel, and the right pixel comprises: setting a weight 0 for weighting the left pixel; setting a weight 1 for weighting the current pixel; setting a weight 0 for weighting the right pixel; and rendering the first type of sub-pixels by the weighted left pixel, the weighted current pixel, and the weighted right pixel. The function of the controller 210 of rendering the second type of sub-pixels by the current pixel and the right pixel comprises: setting a weight 1 for weighting the current pixel; setting a weight 0 for weighting the right pixel; and rendering the second type of sub-pixels by the weighted current pixel and the weighted right pixel. The function of the controller 210 of rendering the third type of sub-pixels by the left pixel and the current pixel comprises: setting a weight 0 for weighting the left pixel; setting a weight 1 for weighting the current pixel; and rendering the first type of sub-pixels by the weighted left pixel and the weighted current pixel. In FIG. 8, the function of the controller 210 of rendering the third type of sub-pixels by the left pixel, the current pixel, and the right pixel comprises: setting a weight 0.25 for weighting the left pixel; setting a weight 0.75 for weighting the current pixel; setting a weight 0 for weighting the right pixel; and rendering the first type of sub-pixels by the weighted left pixel, the weighted current pixel, and the weighted right pixel. The function of the controller 210 of rendering the second type of sub-pixels by the current pixel and the right pixel comprises: setting a weight 0.75 for weighting the current pixel; setting a weight 0.25 for weighting the right pixel; and rendering the second type of sub-pixels by the weighted current pixel and the weighted right pixel. The function of the controller 210 of rendering the third type of sub-pixels by the left pixel and the current pixel comprises: setting a weight 0.25 for weighting the left pixel; setting a weight 0.75 for weighting the current pixel; and rendering the third type of sub-pixels by the weighted left pixel and the weighted current pixel. Moreover, in order to reduce serious shift flickers due to color bleeding issue in another embodiment, the function of the controller 210 of rendering the first type of sub-pixels by the left pixel, the current pixel, and the right pixel comprises: setting a weight 0 for weighting the left pixel; setting a weight 1 for weighting the current pixel; setting a weight 0 for weighting the right pixel; and rendering the first type of sub-pixels by the weighted left pixel, the weighted current pixel, and the weighted right pixel. The function of the controller 210 of rendering the second type of sub-pixels by the current pixel and the right pixel comprises: setting a weight 0.5 for weighting the current pixel; setting a weight 0.5 for weighting the right pixel; and rendering the second type of sub-pixels by the weighted current pixel and the weighted right pixel. The function of the controller 210 of rendering the third type of sub-pixels by the left pixel and the current pixel comprises: setting a weight 0 for weighting the left pixel; setting a weight 1 for weighting the current pixel; and rendering the third type of sub-pixels by the weighted left pixel and the weighted current pixel.

Figure 9:
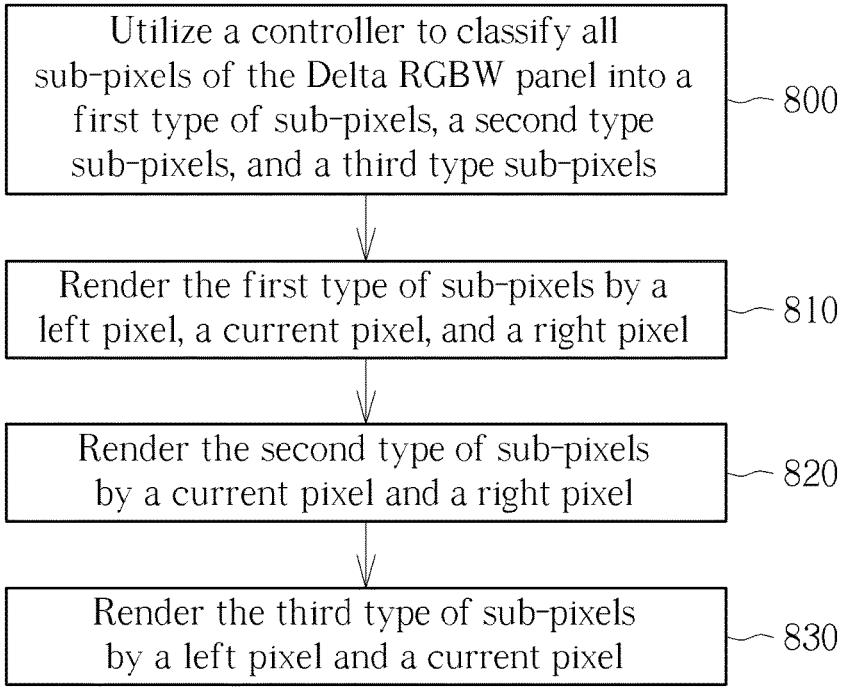
FIG. 9 is a flowchart of a sub-pixel rendering method for the Delta RGBW panel in accordance with an embodiment of the present invention.

Please refer to FIG. 9. FIG. 9 is a flowchart of a sub-pixel rendering method for the Delta RGBW panel 200 in accordance with an embodiment of the present invention. Provided that substantially the same result is achieved, the steps of the process flowchart do not have to be in the exact order shown in FIG. 9 and need not be contiguous, meaning that other steps can be intermediate or certain steps can be ignored. The sub-pixel rendering method of the embodiment of the present invention comprises the following steps:

Step 800: Utilize a controller to classify all sub-pixels of the Delta RGBW panel into a first type of sub-pixels, a second type of sub-pixels, and a third type of sub-pixels.

Step 810: Render the first type of sub-pixels by a left pixel, a current pixel, and a right pixel.

Step 820: Render the second type of sub-pixels by a current pixel and a right pixel.

Step 830: Render the third type of sub-pixels by a left pixel and a current pixel.

Figure 10:
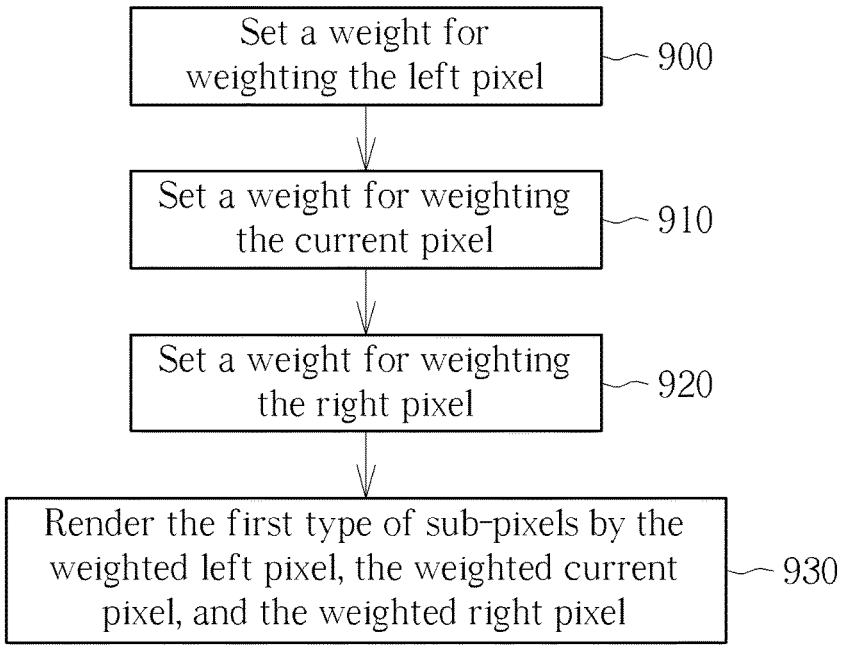
FIG. 10 is a flowchart in accordance with an embodiment of the Step 810 in FIG. 9.

Please refer to FIG. 10. FIG. 10 is a flowchart in accordance with an embodiment of the Step 810 in FIG. 9. The step 810 of rendering the first type of sub-pixels by the left pixel, the current pixel, and the right pixel may comprise the following steps:

Step 900: Set a weight for weighting the left pixel.

Step 910: Set a weight for weighting the current pixel.

Step 920: Set a weight for weighting the right pixel.

Step 930: Render the first type of sub-pixels by the weighted left pixel, the weighted current pixel, and the weighted right pixel.

Figure 11:
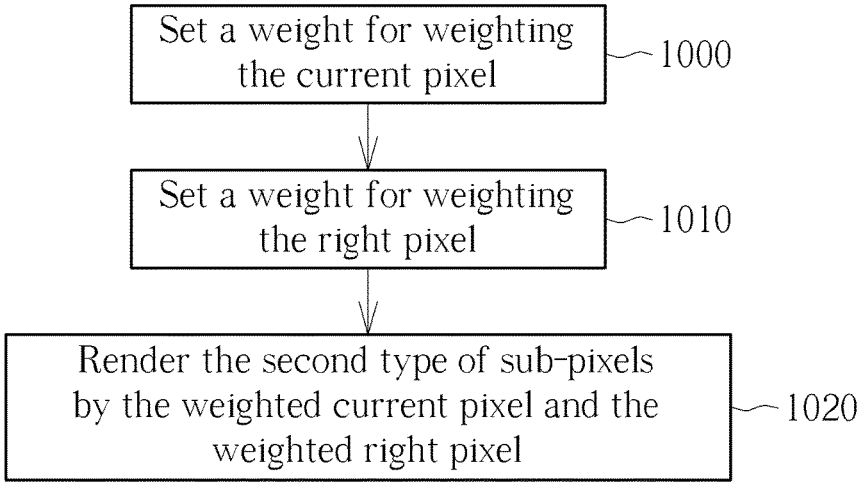
FIG. 11 is a flowchart in accordance with an embodiment of the Step 820 in FIG. 9.

Please refer to FIG. 11. FIG. 11 is a flowchart in accordance with an embodiment of the Step 820 in FIG. 9. The step 820 of rendering the second type of sub-pixels by the current pixel and the right pixel may comprise the following steps:

Step 1000: Set a weight for weighting the current pixel.

Step 1010: Set a weight for weighting the right pixel.

Step 1020: Render the second type of sub-pixels by the weighted current pixel and the weighted right pixel.

Figure 12:
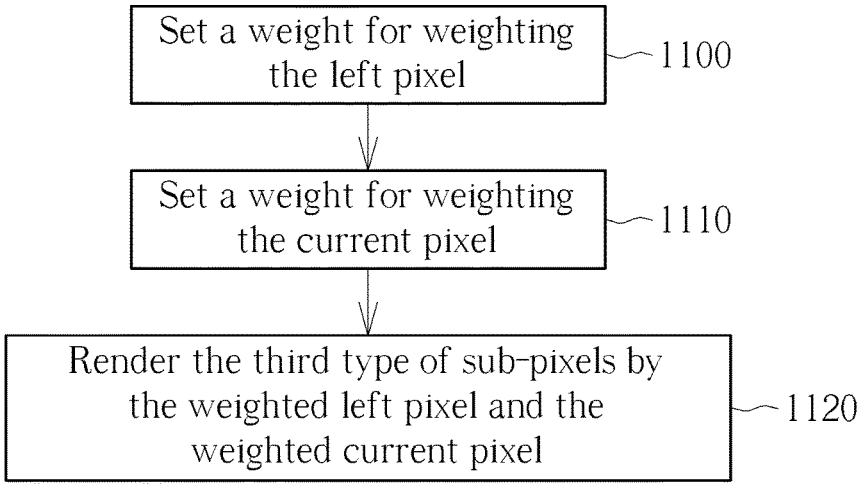
FIG. 12 is a flowchart in accordance with an embodiment of the Step 830 in FIG. 9.

Please refer to FIG. 12. FIG. 12 is a flowchart in accordance with an embodiment of the Step 830 in FIG. 9. The step 830 of rendering the third type of sub-pixels by the left pixel and the current pixel may comprise the following steps:

Step 1100: Set a weight for weighting the left pixel.

Step 1110: Set a weight for weighting the current pixel.

Step 1120: Render the third type of sub-pixels by the weighted left pixel and the weighted current pixel.

Figure 13:
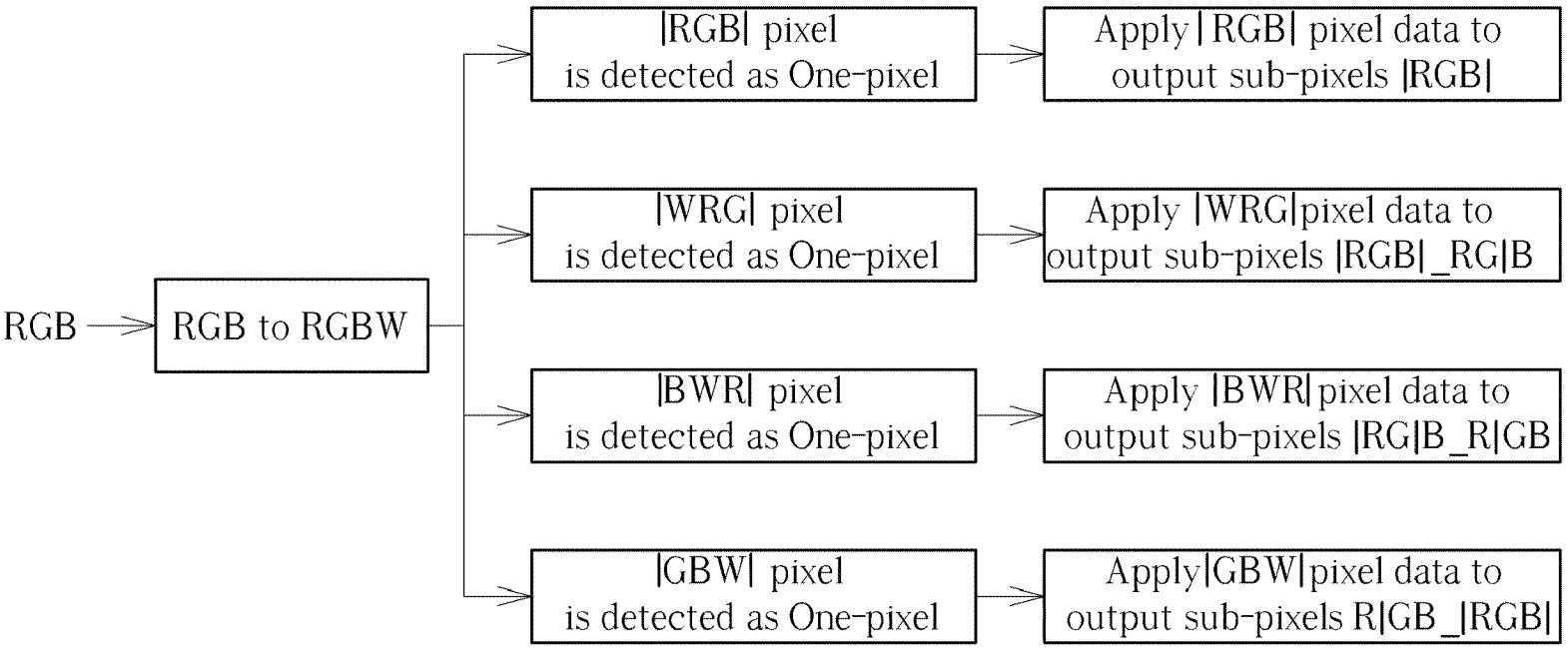
FIG. 13 is a simplified diagram of the sub-pixel rendering method for the Delta RGBW panel in accordance with another embodiment of the present invention.

Moreover, please refer to FIG. 13. FIG. 13 is a simplified diagram of the sub-pixel rendering method for the Delta RGBW panel 200 in accordance with another embodiment of the present invention. As shown in FIG. 13, when the Delta RGBW panel 200 performs a one pixel width slash line connection, the function of the controller 210 can further comprise: applying a first type of pixel data (RGB) to output the first type of sub-pixels; applying a second type of pixel data (WRG) to output the first type of sub-pixels and the second type of sub-pixels; applying a third pixel data (BWR) to output the second type of sub-pixels and the third type of sub-pixels; and applying a fourth pixel data (GBW) to output the third type of sub-pixels and the first type of sub-pixels. In other words, when the Delta RGBW panel 200 performs the one pixel width slash line connection, the one pixel width slash line is not disconnected since three pixels (or two groups of sub-pixels RGB) outputs for one pixel inputs when applying the second type of pixel data (WRG), the third pixel data (BWR), and the fourth pixel data (GBW).

Figure 14:
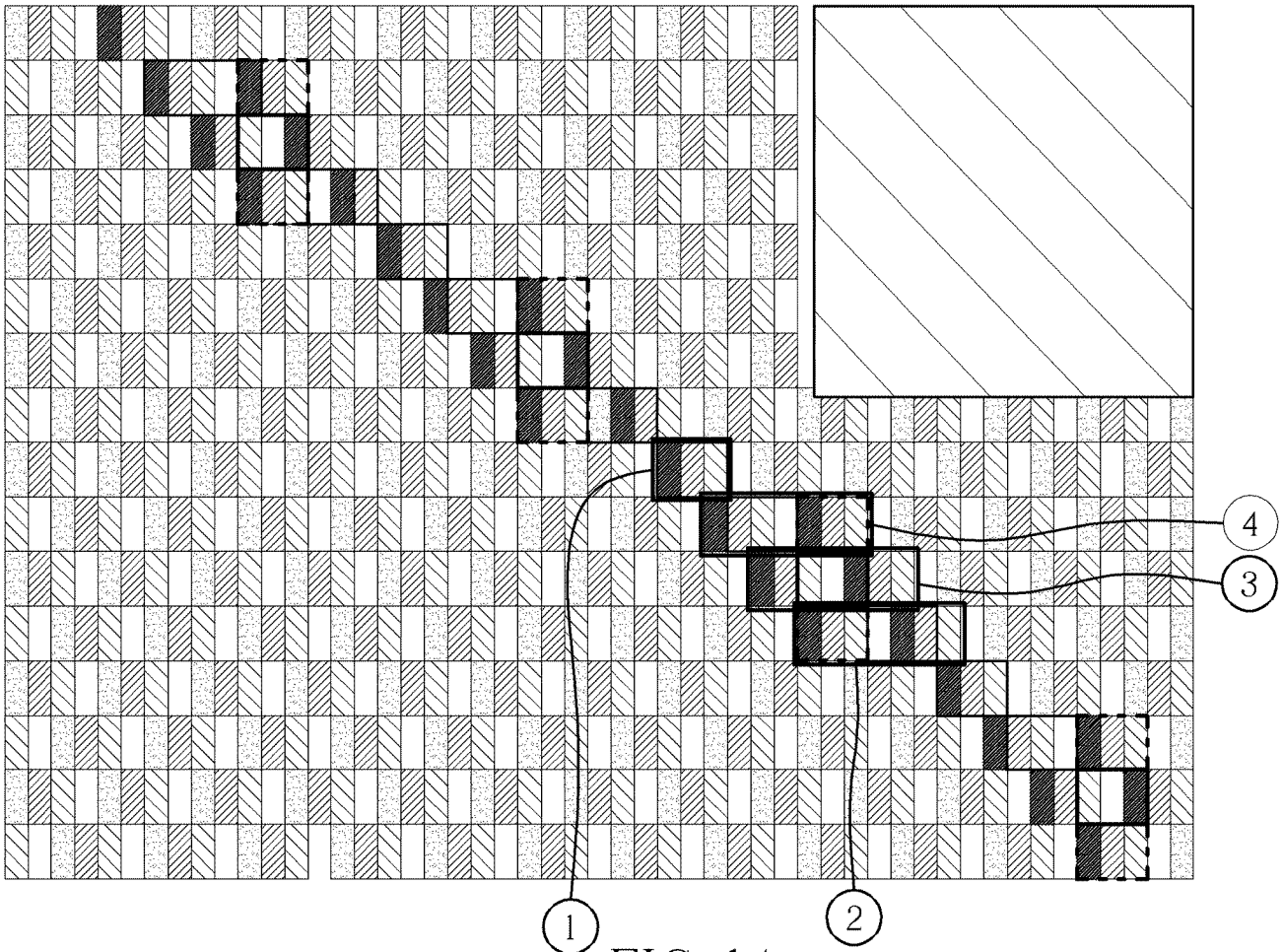
FIG. 14 is a simulation result of the Delta RGBW panel solving the one pixel width slash line disconnection issue in accordance with an embodiment of the present invention.

For example, please refer to FIG. 14. FIG. 14 is a simulation result of the Delta RGBW panel 200 solving the one pixel width slash line disconnection issue in accordance with an embodiment of the present invention. As shown in FIG. 14, the section 1 shows the result of applying the first type of pixel data (RGB) to output the first type of sub-pixels, and the section 2 shows the result of applying the second type of pixel data (WRG) to output the first type of sub-pixels and the second type of sub-pixels, and the section 3 shows the result of applying the third pixel data (BWR) to output the second type of sub-pixels and the third type of sub-pixels, and the section 4 shows the result of applying the fourth pixel data (GBW) to output the third type of sub-pixels and the first type of sub-pixels.

Figure 15:
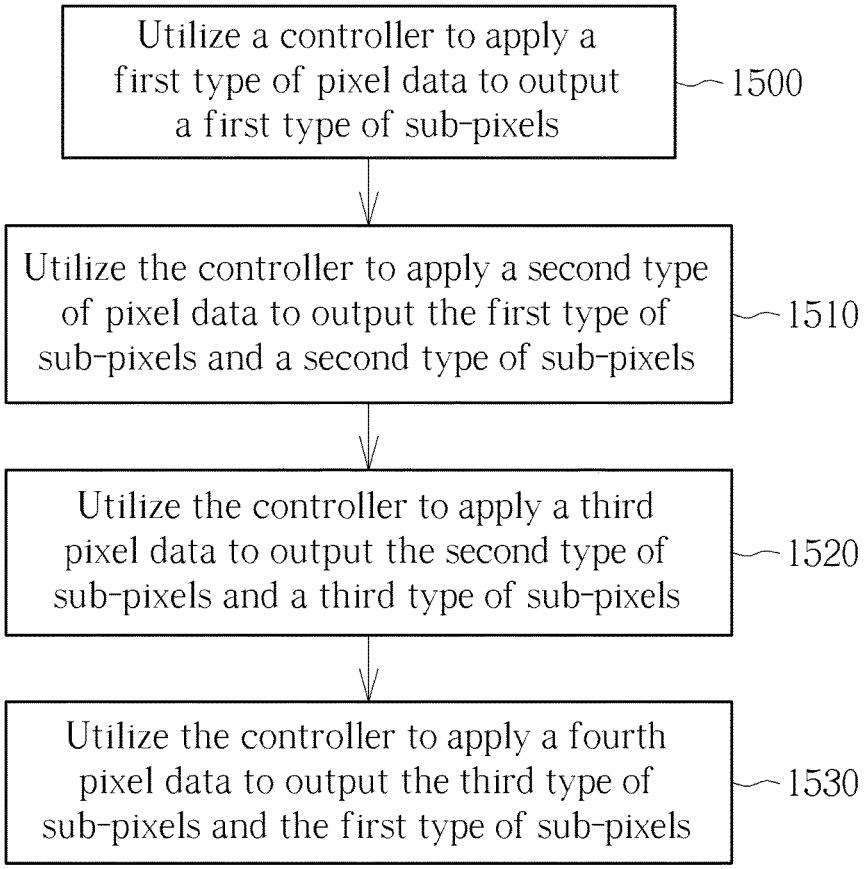
FIG. 15 is a flowchart of a sub-pixel rendering method for the Delta RGBW panel in accordance with the embodiment in FIG. 13 and FIG. 14 of the present invention.

Please refer to FIG. 15. FIG. 15 is a flowchart of a sub-pixel rendering method for the Delta RGBW panel 200 in accordance with the embodiment in FIG. 13 and FIG. 14 of the present invention. Provided that substantially the same result is achieved, the steps of the process flowchart do not have to be in the exact order shown in FIG. 15 and need not be contiguous, meaning that other steps can be intermediate or certain steps can be ignored. The sub-pixel rendering method of the embodiment of the present invention comprises the following steps:

Step 1500: Utilize a controller to apply a first type of pixel data to output a first type of sub-pixels.

Step 1510: Utilize the controller to apply a second type of pixel data to output the first type of sub-pixels and a second type of sub-pixels.

Step 1520: Utilize the controller to apply a third pixel data to output the second type of sub-pixels and a third type of sub-pixels.

Step 1530: Utilize the controller to apply a fourth pixel data to output the third type of sub-pixels and the first type of sub-pixels Briefly summarized, the sub-pixel rendering method for the Delta RGBW panel and the Delta RGBW panel with sub-pixel rendering function disclosed by the embodiments are capable of reducing color bleeding in sub-pixel level and shift flickers due to color bleeding issue and reducing jaggy issue of vertical gray line, and solving one pixel width slash line disconnection issue.

Those skilled in the art will readily observe that numerous modifications and alterations of the device and method may be made while retaining the teachings of the invention.

Accordingly, the above disclosure should be construed as limited only by the metes and bounds of the appended claims.

What is claimed is:

1. A sub-pixel rendering method for a Delta RGBW panel, comprising: utilizing a controller to classify all sub-pixels of the Delta RGBW panel into a first type of sub-pixels, a second type of sub-pixels, and a third type of sub-pixels; rendering the first type of sub-pixels by a left pixel, a current pixel, and a right pixel; rendering the second type of sub-pixels by a current pixel and a right pixel; and rendering the third type of sub-pixels by a left pixel and a current pixel; and wherein step of rendering the first type of sub-pixels by the left pixel, the current pixel, and the right pixel further comprises: setting a weight for weighting the left pixel; setting a weight for weighting the current pixel; setting a weight for weighting the right pixel; and rendering the first type of sub-pixels by the weighted left pixel, the weighted current pixel, and the weighted right pixel.

2. The sub-pixel rendering method of claim 1, wherein step of rendering the second type of sub-pixels by the current pixel and the right pixel comprises: setting a weight for weighting the current pixel; setting a weight for weighting the right pixel; and rendering the second type of sub-pixels by the weighted current pixel and the weighted right pixel.

3. The sub-pixel rendering method of claim 1, wherein step of rendering the third type of sub-pixels by the left pixel and the current pixel comprises: setting a weight for weighting the left pixel; setting a weight for weighting the current pixel; and rendering the third type of sub-pixels by the weighted left pixel and the weighted current pixel.

4. The sub-pixel rendering method of claim 1, wherein when performing a one pixel width slash line connection, the sub-pixel rendering method further comprises:

applying a first type of pixel data to output the first type of sub-pixels;

applying a second type of pixel data to output the first type of sub-pixels and the second type of sub-pixels;

applying a third pixel data to output the second type of sub-pixels and the third type of sub-pixels; and applying a fourth pixel data to output the third type of sub-pixels and the first type of sub-pixels.

5. A Delta RGBW panel with a sub-pixel rendering function, comprising: a controller, for classifying all sub-pixels of the Delta RGBW panel into a first type of sub-pixels, a second type of sub-pixels, and a third type of sub-pixels; rendering the first type of sub-pixels by a left pixel, a current pixel, and a right pixel; rendering the second type of sub-pixels by a current pixel and a right pixel; and rendering the third type of sub-pixels by a left pixel and a current pixel; and wherein the sub-pixel rendering function of the controller rendering the first type of sub-pixels by the left pixel, the current pixel, and the right pixel further comprises: setting a weight for weighting the left pixel; setting a weight for weighting the current pixel; setting a weight for weighting the right pixel; and rendering the first type of sub-pixels by the weighted left pixel, the weighted current pixel, and the weighted right pixel.

6. The Delta RGBW panel of claim 5, wherein the sub-pixel rendering function of the controller rendering the second type of sub-pixels by the current pixel and the right pixel comprises: setting a weight for weighting the current pixel; setting a weight for weighting the right pixel; and rendering the second type of sub-pixels by the weighted current pixel and the weighted right pixel.

7. The Delta RGBW panel of claim 5, wherein the sub-pixel rendering function of the controller rendering the third type of sub-pixels by the left pixel and the current pixel comprises: setting a weight for weighting the left pixel; setting a weight for weighting the current pixel; and rendering the third type of sub-pixels by the weighted left pixel and the weighted current pixel.

8. The Delta RGBW panel of claim 5, wherein when performing a one pixel width slash line connection, the function of the controller further comprises:

applying a first type of pixel data to output the first type of sub-pixels;

applying a second type of pixel data to output the first type of sub-pixels and the second type of sub-pixels;

applying a third pixel data to output the second type of sub-pixels and the third type of sub-pixels; and applying a fourth pixel data to output the third type of sub-pixels and the first type of sub-pixels.

* * * * *